US006931095B1

(12) United States Patent
Koenck et al.

(10) Patent No.: US 6,931,095 B1
(45) Date of Patent: Aug. 16, 2005

(54) SYSTEM AND METHOD FOR IRRADIATING LARGE ARTICLES

(75) Inventors: Steven E. Koenck, Cedar Rapids, IA (US); Stan V. Lyons, Brentwood, CA (US); Brian T. Dalziel, Marion, IA (US); Von Kennedy, Cedar Rapids, IA (US)

(73) Assignee: Mitec Incorporated, Cedar Rapids, IA (US)

( * ) Notice: Subject to any disclaimer, the term of this patent is extended or adjusted under 35 U.S.C. 154(b) by 194 days.

(21) Appl. No.: 10/392,356

(22) Filed: Mar. 19, 2003

Related U.S. Application Data

(60) Provisional application No. 60/365,628, filed on Mar. 19, 2002.

(51) Int. Cl.[7] ..... G21K 5/00
(52) U.S. Cl. ..... 378/64; 378/69
(58) Field of Search ..... 378/64, 68, 69, 378/119, 137, 138, 143; 250/492.1, 492.3

(56) References Cited

U.S. PATENT DOCUMENTS

| | | | | |
|---|---|---|---|---|
| 924,284 | A | 6/1909 | Smith | 131/299 |
| 1,809,078 | A | 6/1931 | Smith | 378/69 |
| 2,963,369 | A | 12/1960 | Urbain | 426/240 |
| 3,560,745 | A | 2/1971 | Petersen et al. | 378/69 |
| 3,876,373 | A | 4/1975 | Glyptis | 422/23 |
| 4,484,341 | A | 11/1984 | Luniewski | 378/69 |
| 4,652,763 | A | 3/1987 | Nablo | 250/492.3 |
| 4,767,930 | A | 8/1988 | Stieber et al. | 250/396 ML |
| 5,026,983 | A | 6/1991 | Meyn | 250/223 R |
| 5,323,442 | A | 6/1994 | Golovanivsky et al. | 378/119 |
| 5,396,074 | A | 3/1995 | Peck et al. | 250/453.11 |
| 5,461,656 | A | 10/1995 | Golovanivsky et al. | 378/66 |
| 5,482,726 | A | 1/1996 | Robinson, Jr. | 426/238 |
| 5,635,714 | A | 6/1997 | Nablo et al. | 250/305 |
| 5,838,760 | A | 11/1998 | Moses | 378/119 |
| 5,847,401 | A * | 12/1998 | McKeown et al. | 250/396 ML |
| 5,994,706 | A | 11/1999 | Allen et al. | 250/454.11 |
| 6,023,497 | A | 2/2000 | Takahashi et al. | 378/57 |
| 6,127,687 | A | 10/2000 | Williams et al. | 250/492.3 |
| 6,232,610 | B1 | 5/2001 | Pageau et al. | 250/474.1 |
| 6,429,444 | B1 | 8/2002 | Korenev et al. | 250/492.3 |
| 6,504,898 | B1 * | 1/2003 | Kotler et al. | 378/64 |
| 6,653,641 | B2 * | 11/2003 | Lyons et al. | 250/492.2 |
| 6,738,451 | B2 * | 5/2004 | Avnery | 378/64 |

* cited by examiner

*Primary Examiner*—Edward J. Glick
*Assistant Examiner*—Courtney Thomas
(74) *Attorney, Agent, or Firm*—Kinney & Lange, P.A.

(57) ABSTRACT

An irradiation assembly is effective to irradiate large articles, up to about 48 inches thick in an exemplary embodiment. The assembly provides radiation to an article from all sides in a 360 degree exposure range, and includes at least one irradiating subsystem that provides x-ray radiation in a portion of the 360 degree exposure range. A conveying system carries the article through the at least one irradiating subsystem in a number of passes appropriate to provide x-ray radiation to the article in the full 360 degree exposure range. Each irradiating subsystem is configured to direct radiation toward a center point of the article being irradiated. An accelerator generates an electron beam, and a magnet assembly shapes and deflects the electron beam in a sweep path through a scan horn. A compound bending magnet directs the electron beam toward a center point of the article being irradiated along the entire sweep path. An x-ray conversion plate converts the electron beam into an x-ray radiation beam.

31 Claims, 14 Drawing Sheets

SYSTEM AND METHOD FOR IRRADIATING LARGE ARTICLES

CROSS-REFERENCE TO RELATED APPLICATION(S)

This application claims the benefit of U.S. Provisional Application No. 60/365,628 filed Mar. 19, 2002 for "Irradiation System With Improved Dosage Uniformity For Large Articles" by S. Koenck, S. Lyons, B. Dalziel and V. Kennedy.

INCORPORATION BY REFERENCE

The aforementioned U.S. Provisional Application No. 60/365,628 is hereby incorporated by reference in its entirety.

BACKGROUND OF THE INVENTION

The present invention relates to an irradiation system and method, and more particularly to an x-ray irradiation system configured to uniformly expose large articles such as loaded shipping pallets to ionizing radiation.

Irradiation systems for pasteurization of food products and materials increasingly employ machine-generated radiation as the source of the ionizing radiation that eliminates harmful food borne pathogens. The FDA and USDA approved machine generated radiation sources are high energy accelerated electrons and x-ray photons. Electron beam irradiation is a process in which high-energy electrons up to 10 MeV are directed toward food products to be processed. Because of their particle characteristics, high-energy electrons have limited penetration capability and are useful for irradiating materials only up to about 4 centimeters (cm) in thickness in single-sided configurations and about 9 cm in two-sided applications.

By contrast, x-rays are capable of much greater penetration. The x-ray depth-dose curve is characterized by an e-x mathematical function with a "tail" that penetrates on an attenuated but continuing basis. The $e^{-x}$ curve represents both an opportunity and a difficulty for irradiation of large articles. The opportunity is afforded by the deep penetration potential of the depth-dose curve tail. The difficulty is that it is important for the delivered radiation dosage in food products to be as uniform and constant as possible. An important measure of dosage uniformity is the maximum/minimum ratio defined as the ratio between the peak dose and the minimum dose over the physical volume of the product being processed. Ideally, the max/min ratio would be as close to 1.0:1 as possible. In general, a max/min ratio of 1.3:1 to 1.6:1 is considered acceptable for most applications.

Two-sided application of x-ray radiation is somewhat helpful to improve the max/min ratio for materials up to about 45 cm (18 inches) in thickness. Unfortunately, there are many food material configurations that require processing of thicknesses up to 48 inches, in particular products that are packaged in boxes and placed on palleted shipping containers. The typical two-sided penetration capability of the available radiation sources is insufficient to deliver a max/min ratio as low as 1.6:1 for materials this thick. An alternate methodology is needed to provide this capability.

BRIEF SUMMARY OF THE INVENTION

The present invention is an irradiation assembly that is effective to irradiate large articles, up to about 48 inches thick in an exemplary embodiment. The assembly provides radiation to an article from all sides in a 360 degree exposure range, and includes at least one irradiating subsystem that provides x-ray radiation in a portion of the 360 degree exposure range. A conveying system carries the article through the at least one irradiating subsystem in a number of passes appropriate to provide x-ray radiation to the article in the full 360 degree exposure range.

Each irradiating subsystem is configured to direct radiation toward a center point of the article being irradiated. An accelerator generates an electron beam, and a magnet assembly shapes and deflects the electron beam in a sweep path through a scan horn. A compound bending magnet directs the electron beam toward a center point of the article being irradiated along the entire sweep path. An x-ray conversion plate converts the electron beam into an x-ray radiation beam.

DETAILED DESCRIPTION

Irradiation systems for pasteurization of food products and materials employ either high energy accelerated electrons or x-ray photons. Accelerated electrons are provided by a radiation generating source in the form of an electron beam. These electrons can themselves be used to irradiate the product being treated, or can be converted into x-rays by an appropriate conversion plate. X-ray systems typically achieve greater penetration in the product being treated, as explained below.

Figure 1A:
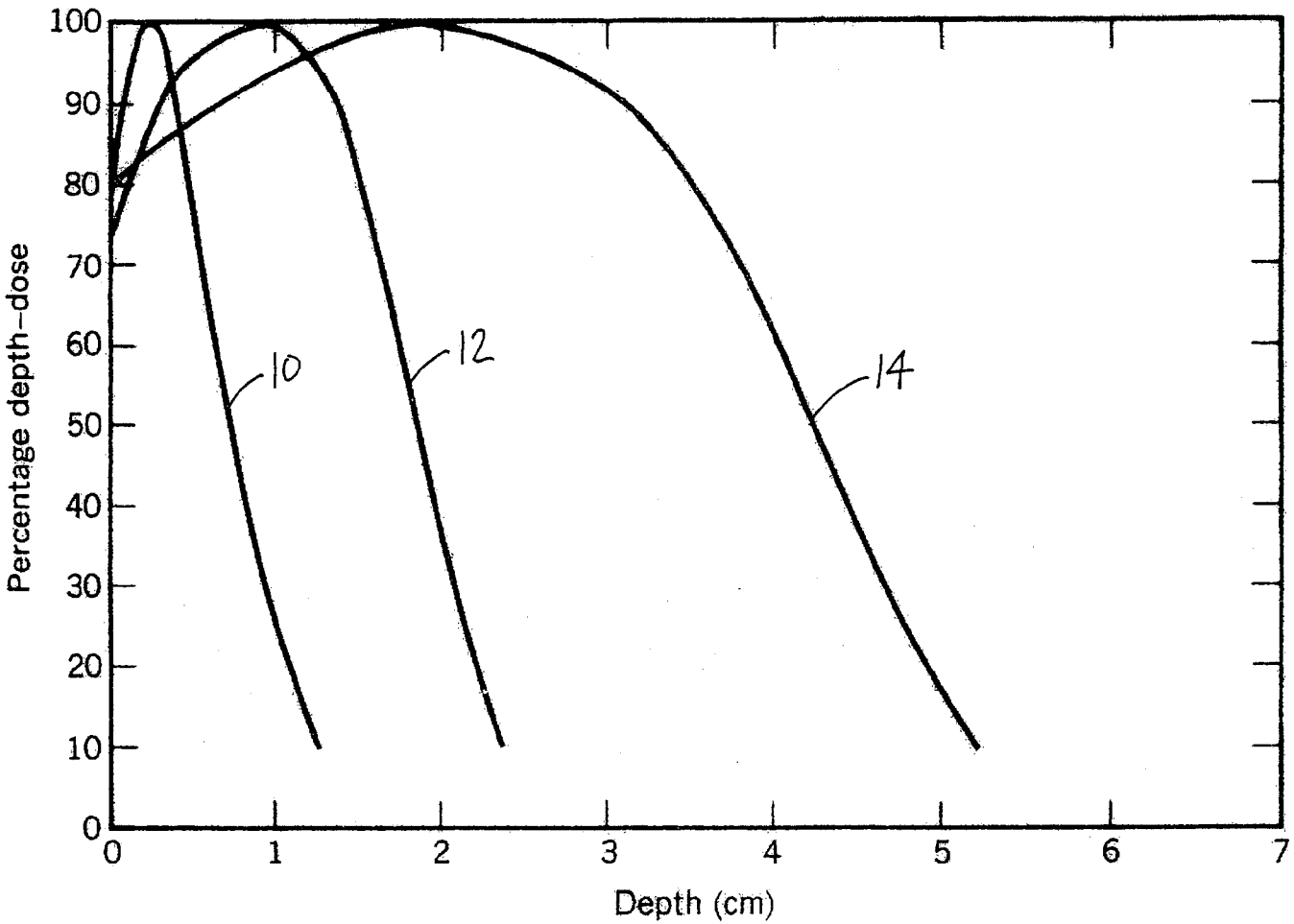
FIG. 1A is a graph illustrating depth-dose curves achieved by electron beams of various different energy levels.

FIG. 1A is a graph illustrating depth-dose curves achieved by electron beams of various different energy levels. Curve 10 is the depth-dose curve for 1.8 mega electron-volt (MeV) electrons, curve 12 is the depth-dose curve for 4.7 MeV electrons, and curve 14 is the depth-dose curve for 10.6 MeV electrons. Each of these curves have a pronounced "hump" shape with virtually no penetration past the falloff point. This radiation profile limits the ability of electron beams to penetrate articles larger than about 9 centimeters, even with double-sided irradiation.

Figure 1B:
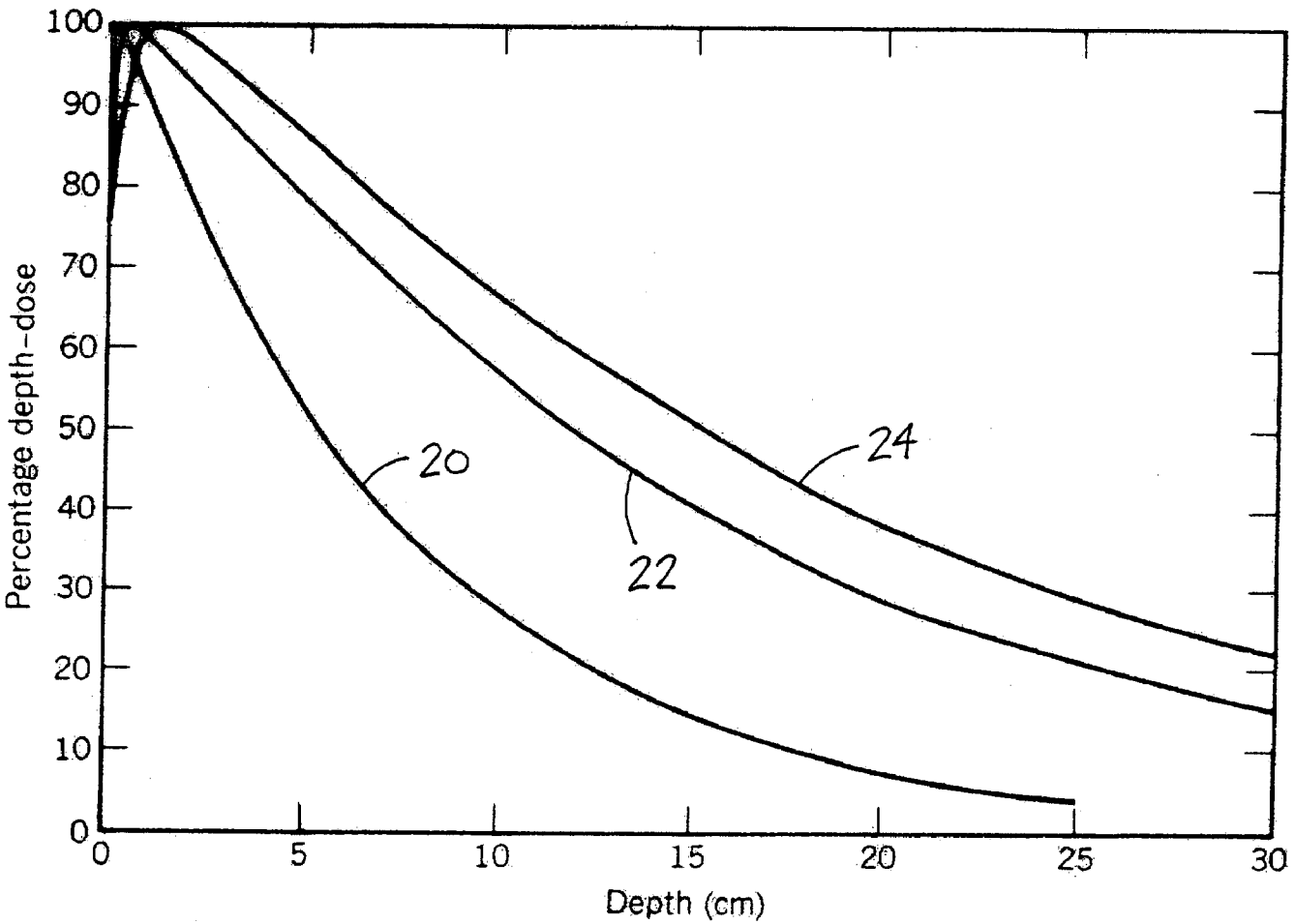
FIG. 1B is a graph illustrating depth-dose curves achieved by various types of x-ray radiation.

FIG. 1B is a graph illustrating depth-dose curves achieved by various types of x-ray radiation. Curve 20 is the depth-dose curve for Cesium-137 gamma radiation, curve 22 is the depth-dose curve for Cobalt-60 gamma radiation, and curve 24 is the depth-dose curve for 4 MeV x-ray radiation. In contrast to the "humped" shape of the electron beam radiation profiles shown in FIG. 1A, the x-ray radiation profiles shown in FIG. 1B are characterized by an e-x mathematical function with a "tail" that penetrates on an attenuating but continuing basis. This characteristic allows a greater depth of penetration to be achieved, although this penetration is still limited by an allowable maximum/minimum (max/min) ratio. Curve 24 shows that the dose delivered at a penetration depth of 30 cm is approximately 22% of the maximum dose delivered at approximately 1.5 cm. For single-sided x-ray irradiation of material 30 cm. thick, the max/min ratio would be 100/22.5 or approximately 4.44. Ideally, the max/min ratio would be as close to 1.0:1 as possible. In general, a max/min ratio of 1.3:1 to 1.6:1 is considered acceptable for most applications.

Figure 2:
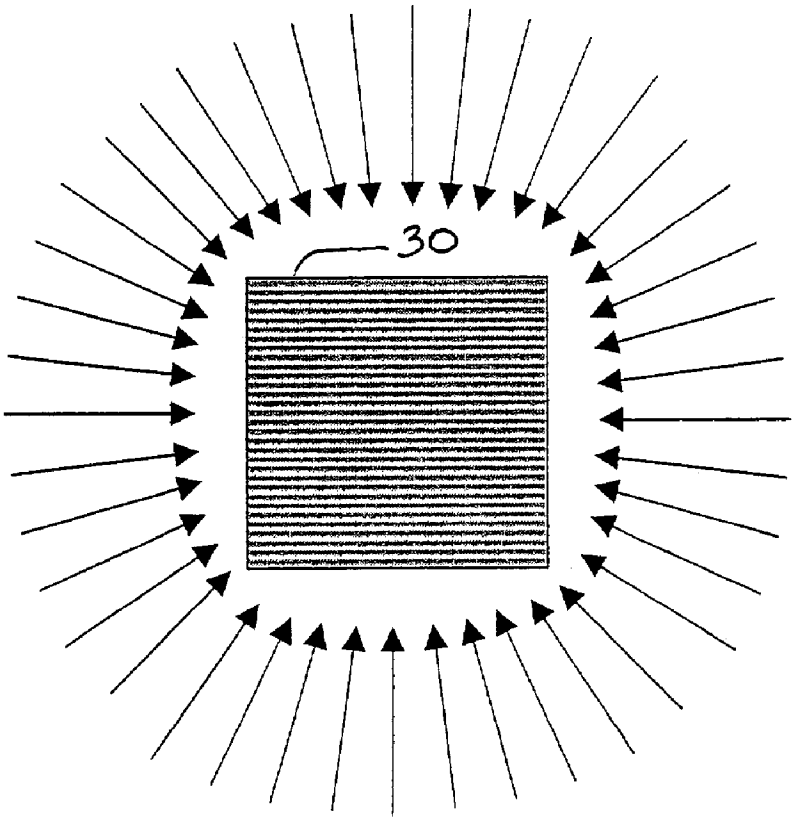
FIG. 2 is a diagram illustrating the direction of ionizing radiation at a product from multiple sides in a radial manner.

A solution to this problem is to direct x-ray radiation toward the center of the large article to be processed in a radial manner. FIG. 2 is a diagram illustrating the direction of ionizing radiation at pallet 30 of material from multiple sides in such a radial manner. The x-ray radiation is applied to the article as a series of pulsed deeply penetrating elliptical spots of predetermined height and width that are overlapped by at least 50% at the exterior of the article to be processed. As can be seen, the radial geometry causes every spot penetrating path to traverse through a common point at the center of the article. This geometry allows the successive partial exposure due to each individual pulsed spot to be summed, which causes the exposure at the extreme interior of the large article to be increased substantially beyond what might be achieved with ordinary single or two-sided exposure. The summed exposure at the extreme interior results in increased dosage at this otherwise much reduced region, which significantly improves the uniformity of dosage even for very large articles such as pallets of food materials.

Figure 3:
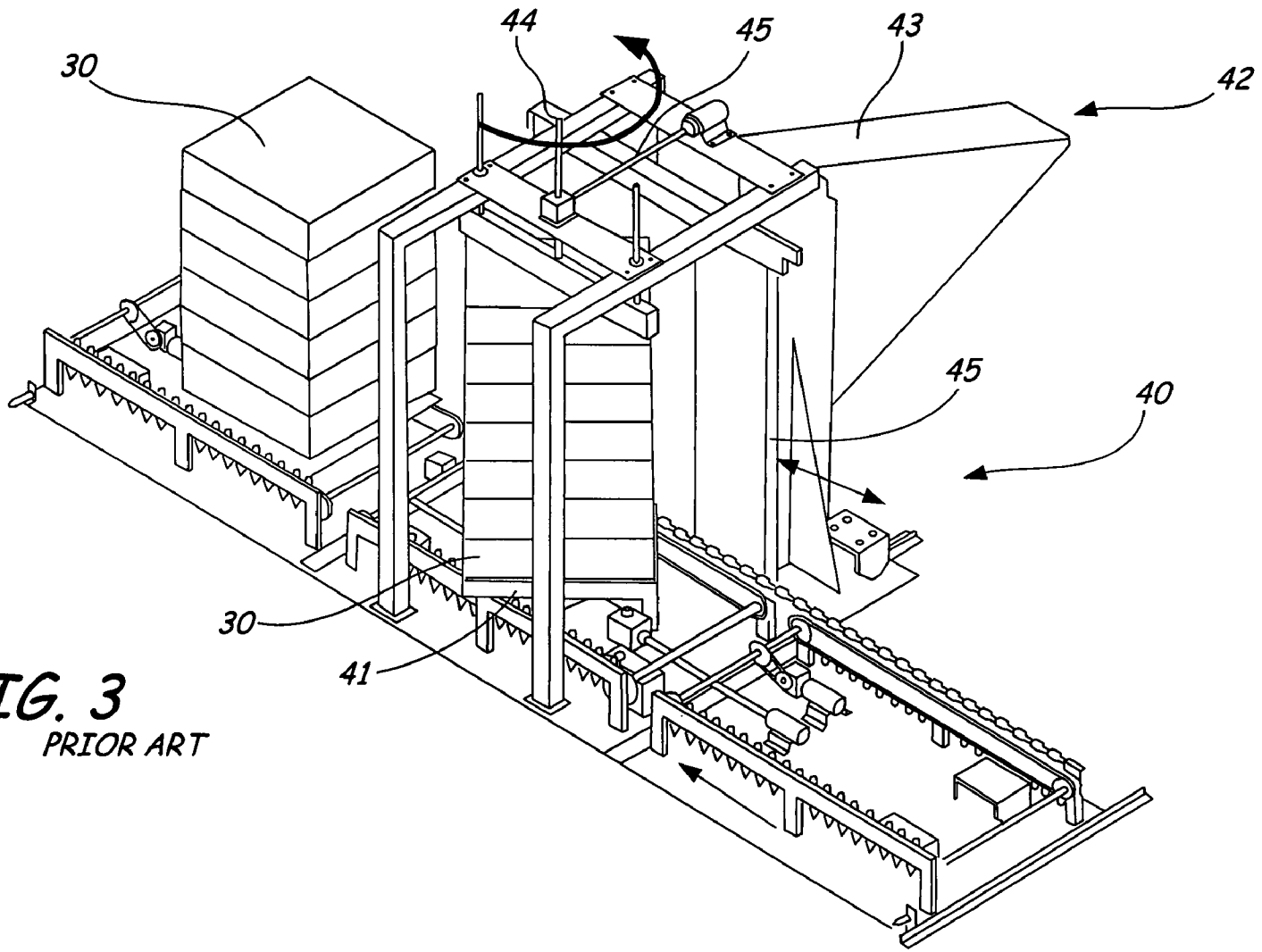
FIG. 3 PRIOR ART
FIG. 3 is a diagram of a prior art irradiation system employing a turntable to provide ionizing radiation to a product from multiple sides.

Radial application of deeply penetrating x-ray radiation has been employed by MDS Nordion and IBA Corporation in a system called the Palletron pallet irradiation system. FIG. 3 is a diagram of the Palletron system 40, which applies deeply penetrating x-ray radiation in a radial manner by conveying pallet 30 of material onto rotating turntable 41 located in front of electron beam radiation source 42 having x-ray generating scan horn 43. Pallet 30 is turned slowly about its vertical axis 44 as the x-ray radiation is scanned up and down. A shutter apparatus consisting of a pair of x-ray absorbing doors 45 is located between the scan horn x-ray conversion plate (not shown in FIG. 3) and pallet 30 to shape the x-ray pattern and to attenuate the x-ray intensity during the times that the face of pallet 30 is turned toward scan horn 43. This technique is used to normalize the exposure applied to the material by accounting for the greater absorption caused by the relatively shorter path through the flat face of pallet 30 of material. When the corner of the pallet is facing the scan horn x-ray conversion plate, shutter doors 45 are opened to increase the radiation intensity as it passes through the corner path to the center diagonally.

A disadvantage of prior art x-ray irradiation system 40 of FIG. 3 is that the shutter shaping and attenuation method causes valuable x-ray energy to be converted to heat and be wasted. Inefficient utilization of x-ray radiation is especially costly due to the relatively low electron beam to x-ray conversion efficiency of 8%. Every watt of x-ray energy wasted represents an equivalent loss of approximately 12 watts of electron beam energy. A further disadvantage of prior art system 40 of FIG. 3 is the dependence on precise mechanical movement and rotation of the pallet of material to be processed to achieve the desired dosage uniformity. The timing and control of shutter doors 45 must be precisely mechanically synchronized with the rotation of the pallet on turntable 41 to compensate for the varying material thickness. In general, this system depends primarily on mechanical material movement components to achieve the dosage uniformity objective.

Figure 4:
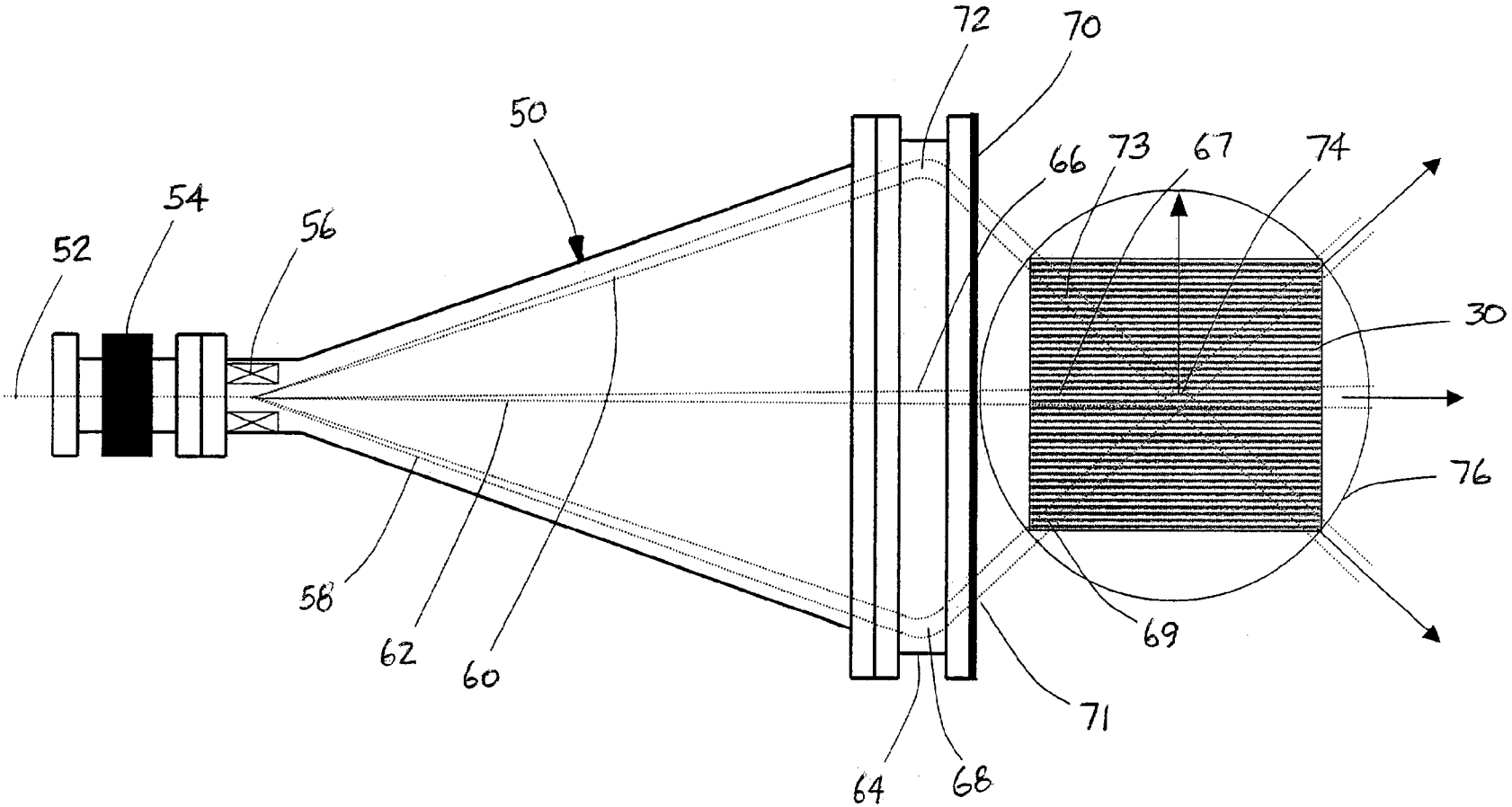
FIG. 4 is a diagram of an x-ray scan horn according to an embodiment of the present invention.

For purposes of reliability and precision, it would be highly desirable to apply x-ray radiation to large pallets of material using electrical and computer controlled components that would have little dependence on mechanical components. Referring now to FIG. 4 and following figures, a system will be described that accomplishes that objective.

FIG. 4 is a diagram of an x-ray scan horn 50 configured according to an embodiment of the present invention. A beam of accelerated electrons 52 is received from an accelerator and enters scan horn structure 50. Quadrupole magnet 54 is optionally employed to shape electron beam 52, and scanning deflection electromagnet 56 (shown schematically for the sake of simplicity) deflects electron beam 52 in an amount proportional to a current through deflection magnet 56 under computer control (not shown). Path 58 represents a maximum deflection in the lower direction, path 60 represents a maximum deflection in the upper path, and path 62 represents the direction of beam 52 with essentially no current passing through deflection magnet 56. Compound bending magnet assembly 64 receives the deflected beams as directed by deflection magnet 56 and redirects the electrons at an angle dependent on where the electron beam enters compound bending magnet assembly 64. Compound bending magnet assembly 64 includes of a set of electromagnets associated together to create a static magnetic field of varying intensity proportional to the entry location. This field intensity will be approximately zero at the center of the compound bending magnet; it will be at a maximum positive (magnetic north) intensity at one extremity; and it will be at maximum negative (magnetic south) at the opposite extremity. If the beam enters at the middle of the compound bending magnet at point 66 where the magnetic field strength is approximately zero, it will not be deflected, but will continue straight out in continuation of the direction of beam path 62 along path 67. If the beam enters at the extreme lower point of the bending magnet 64 at position 68, the magnet will deflect the electrons toward path 69. After being bent by the compound bending magnet, the electrons strike x-ray conversion plate 70 at point 71, where they are converted to x-ray energy and continue along path 69. Similarly, electrons that are deflected along path 60 enter the extreme upper point of the compound bending magnet 64 at point 72 and are directed toward and through x-ray conversion plate 70 along path 73. Although the x-ray beams exiting conversion plate 70 diverge somewhat in a generally conical shape, the centers of the x-ray beams have the highest intensity and are directed as shown in FIG. 4. The angle of the deflection of compound bending magnet 64 is precisely determined to direct electrons that enter compound bending magnet 64 from any point toward a single point 74 located at a selected distance from the exit of scan horn structure 50. This method creates a set of radially directed x-rays covering a radial angle of 90 degrees that all impinge on the single point 74 with no mechanical moving parts. As described in more detail below, four of these structures may be disposed to direct x-ray radiation toward a pallet of material from a total of 360 degrees to apply radiation as illustrated generally in FIG. 2.

As described above, x-ray radiation is generated by striking a conversion plate with energetic electrons. The typical materials for this conversion plate are dense metals such as tungsten or tantalum, since the conversion efficiency is directly proportional to the atomic number of the conversion material. The thickness of material that the electrons must pass through is preferably a constant for consistent x-ray intensity.

The radiation geometry illustrated in FIG. 4 is useful to describe a further important feature of the present invention. X-ray beam paths 69 and 73 that pass through the diagonals of square pallet 30 propagate through more material than normal path 67 that is directed toward the flat face of pallet 30. Since the length of the path from the face to the center is shorter than the diagonal path, the dose received through this path is higher than the dose received through the diagonal path. A useful way to analyze this phenomenon is to consider applying x-ray radiation radially to cylinder 76 having center 74. In this case, all of the paths to the center of cylinder 76 would be exactly the same length, so the dose in the interior of cylinder 76 due to each radially applied beam would be identical. The difference in absorbed dose between a cylindrical shape and a square shape may be considered as a simple matter of accounting for the material that is not present in the square by subtracting the distance from the diameter of the cylinder to the surface of the square. This reduced material thickness results in an increased intensity of x-ray radiation applied to the surface of the square that is closer to center 74 by this distance.

Figure 5:
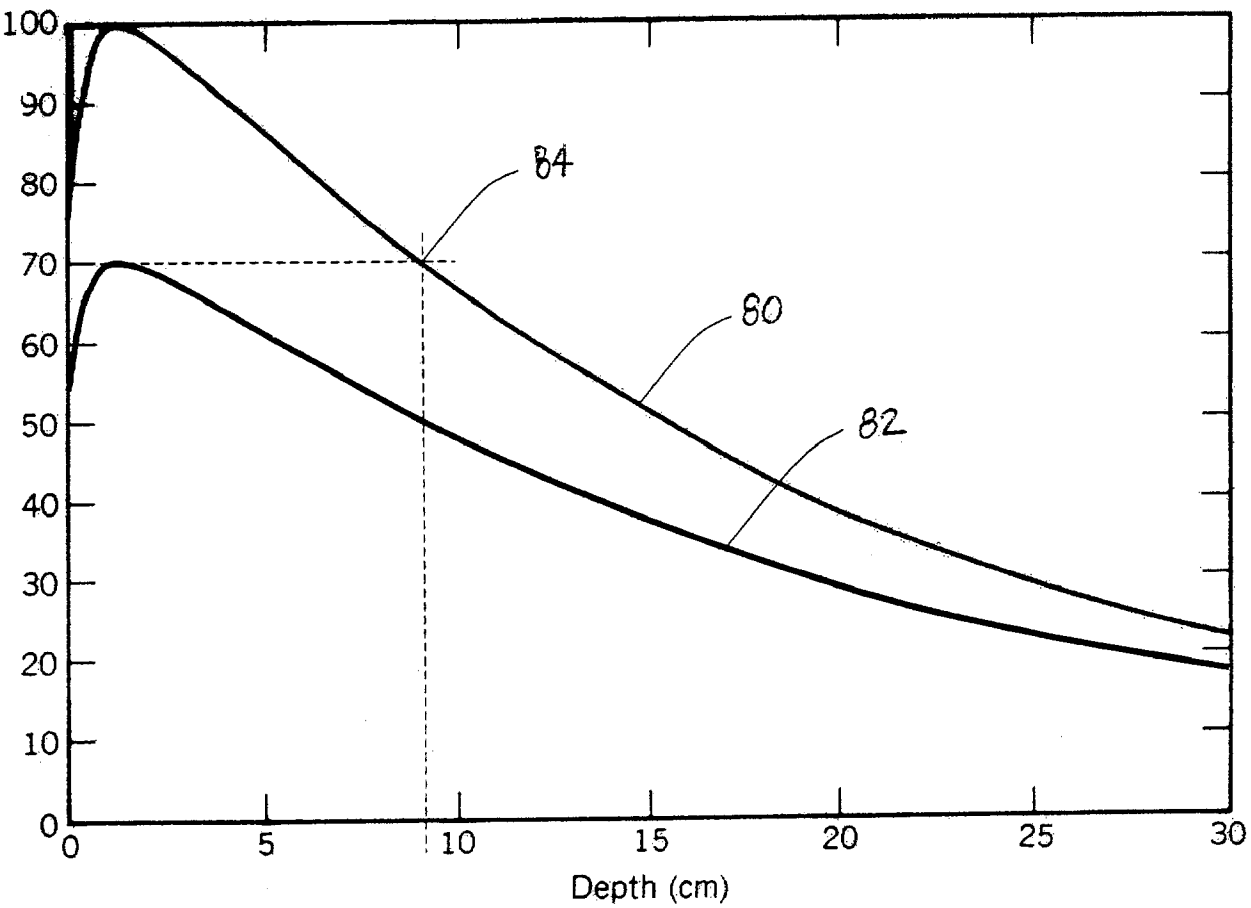
FIG. 5 is a graph illustrating the depth-dose curves of full intensity x-rays and of reduced intensity x-rays.

FIG. 5 is a graph illustrating the depth-dose curves of full intensity x-rays and of reduced intensity x-rays. Full intensity x-ray depth-dose curve 80 is shown with its characteristic e-x absorption curve. Reduced intensity x-ray depth-dose curve 82 has approximately 70% of the intensity of curve 80. Reduced intensity curve 82 may be realized by reducing the power of the incident electron beam that is converted to x-ray radiation either by reducing the electron current or by shortening the pulse time of the electron beam pulse. In effect, reducing the intensity of x-rays (curve 82) has the same effect as applying full intensity x-rays (curve 80) beginning at a depth of approximately 9 cm, as indicated at point 84 on curve 80. If the thickness of the difference between the cylinder and the face of the square is 9 cm, the application of reduced intensity x-rays (curve 82) will compensate for the square geometry in an optimal manner exactly as if the pallet were a cylinder.

Reduced intensity curve 82 may be utilized for improved system efficiency. An electron beam accelerator capable of variable duty cycle and variable pulse repetition rate is operable to increase the x-ray intensity during the time that the pulses are being applied to the center region (path 66, FIG. 4) of compound bending magnet 64, and to decrease the x-ray intensity proportionally when the pulses are applied near the extremities (paths 68 and 72) of compound bending magnet 64. The net average power developed by the electron beam accelerator and applied by the system may be maintained at a nearly constant level with virtually no loss of efficiency. Even more importantly, the output power of the accelerator may be maintained at its maximum level to maximize the capacity of the system.

Figure 6B:
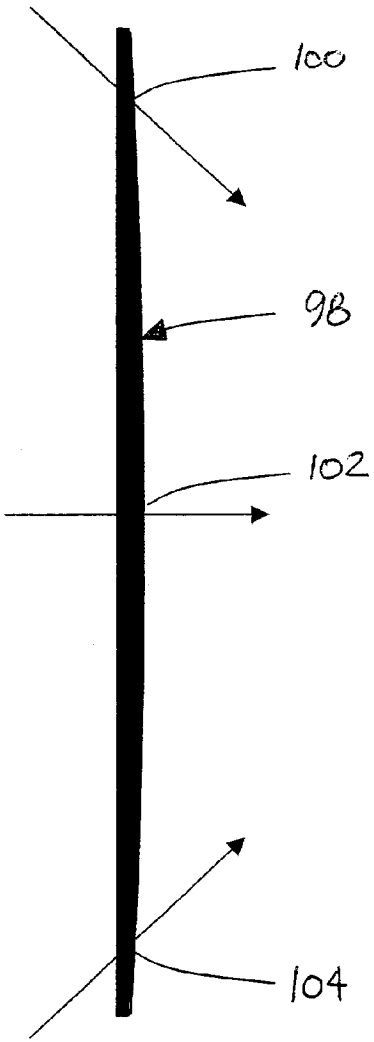
FIG. 6B is a diagram illustrating a conversion plate having variable thickness to equalize the path lengths for x-rays passing through the conversion plate from different angles.
Figure 6A:
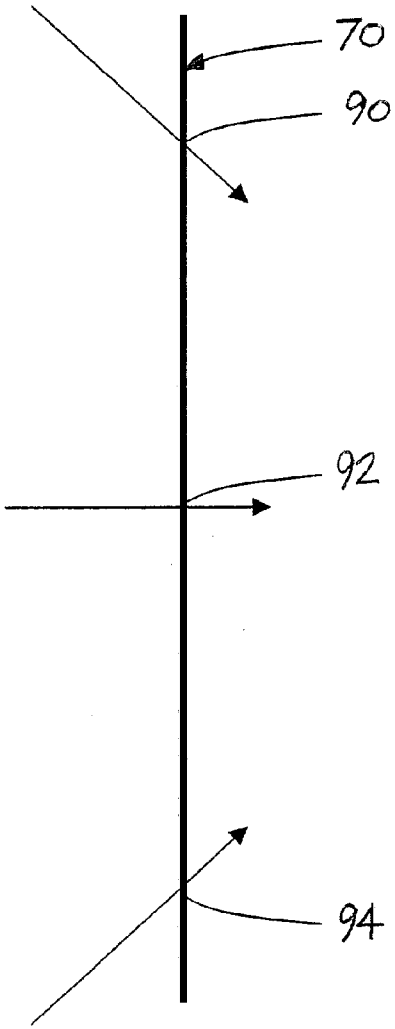
FIG. 6A is a diagram illustrating the different path lengths for x-rays passing through a conversion plate from different angles.

FIG. 6A is a diagram illustrating the different path lengths for x-rays passing through uniform conversion plate 70 from different angles. The angles that the electrons pass through conversion plate 70 are dependent on the incident location. If the electrons strike either upper point 90 or the lower point 94 of uniform conversion plate 70, the diagonal path through the conversion plate will be longer than if the electrons strike uniform plate 70 at a normal angle such as at point 92.

FIG. 6B is a diagram illustrating compensating conversion plate 98 according to an embodiment of the present invention. Compensating conversion plate 98 is thicker in central region 102 than at upper extremity 100 and lower extremity 104. Since the angles of exit are known in advance due to the path geometry illustrated in FIG. 4, conversion plate 98 may be designed for constant path thickness, yielding consistent x-ray intensity exiting conversion plate 98.

Figure 7:
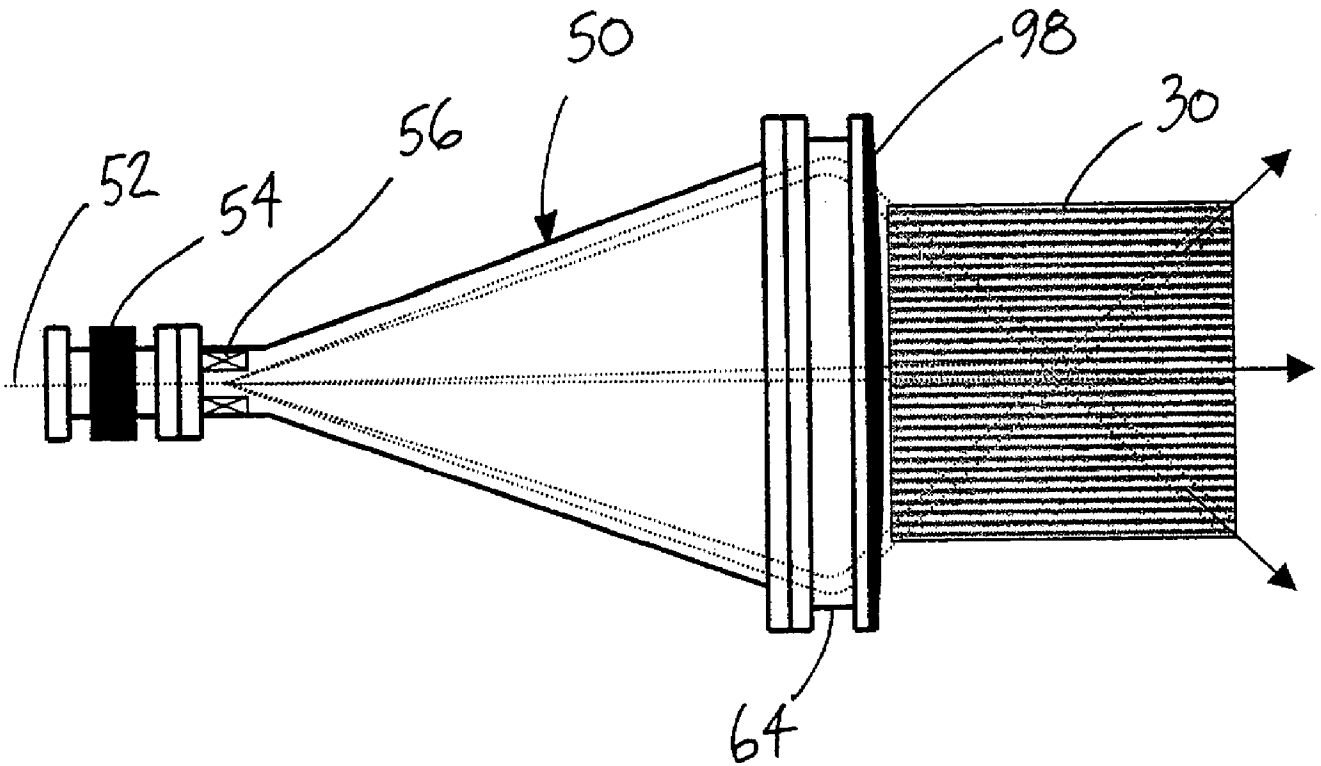
FIG. 7 is a diagram of an x-ray scan horn employing a variable thickness x-ray conversion plate according to an embodiment of the present invention.

FIG. 7 is a diagram illustrating the radially applied x-ray system 303 described above with respect to FIG. 4 employing compensating x-ray conversion plate 98 described above with respect to FIG. 6B. When this system is combined with three other such systems, x-ray radiation may be applied to all 360 degrees surrounding thick materials such as a pallet of food products.

Figure 8:
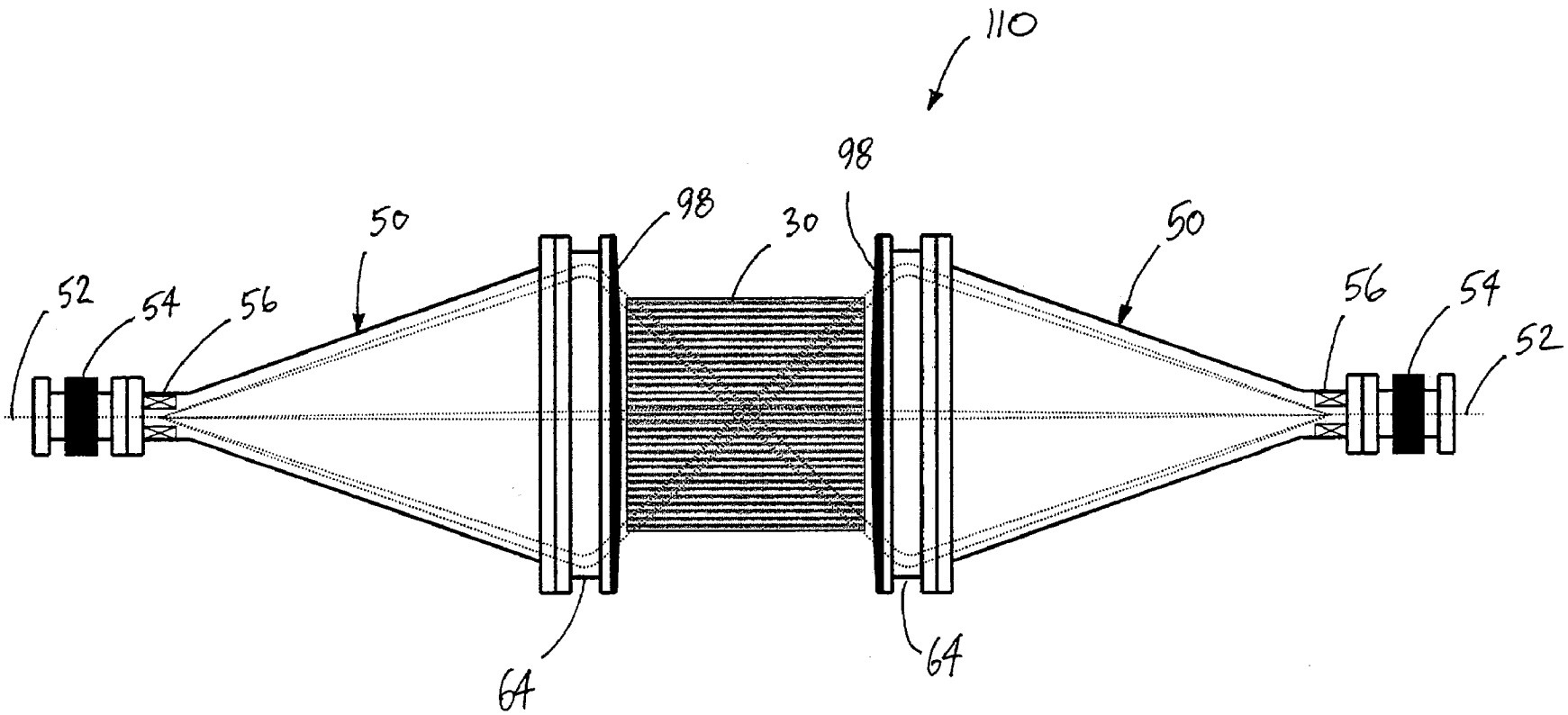
FIG. 8 is a diagram of an irradiation subsystem having two horizontally arranged x-ray scan horns according to an embodiment of the present invention.

FIG. 8 is a diagram of irradiation subsystem 110 having two horizontally arranged x-ray scan horns 50. In practice, scan horns 50 will be offset laterally so that the x-ray radiation that exits pallet 30 of material being processed does not impinge upon the opposite scan horn.

Figure 9:
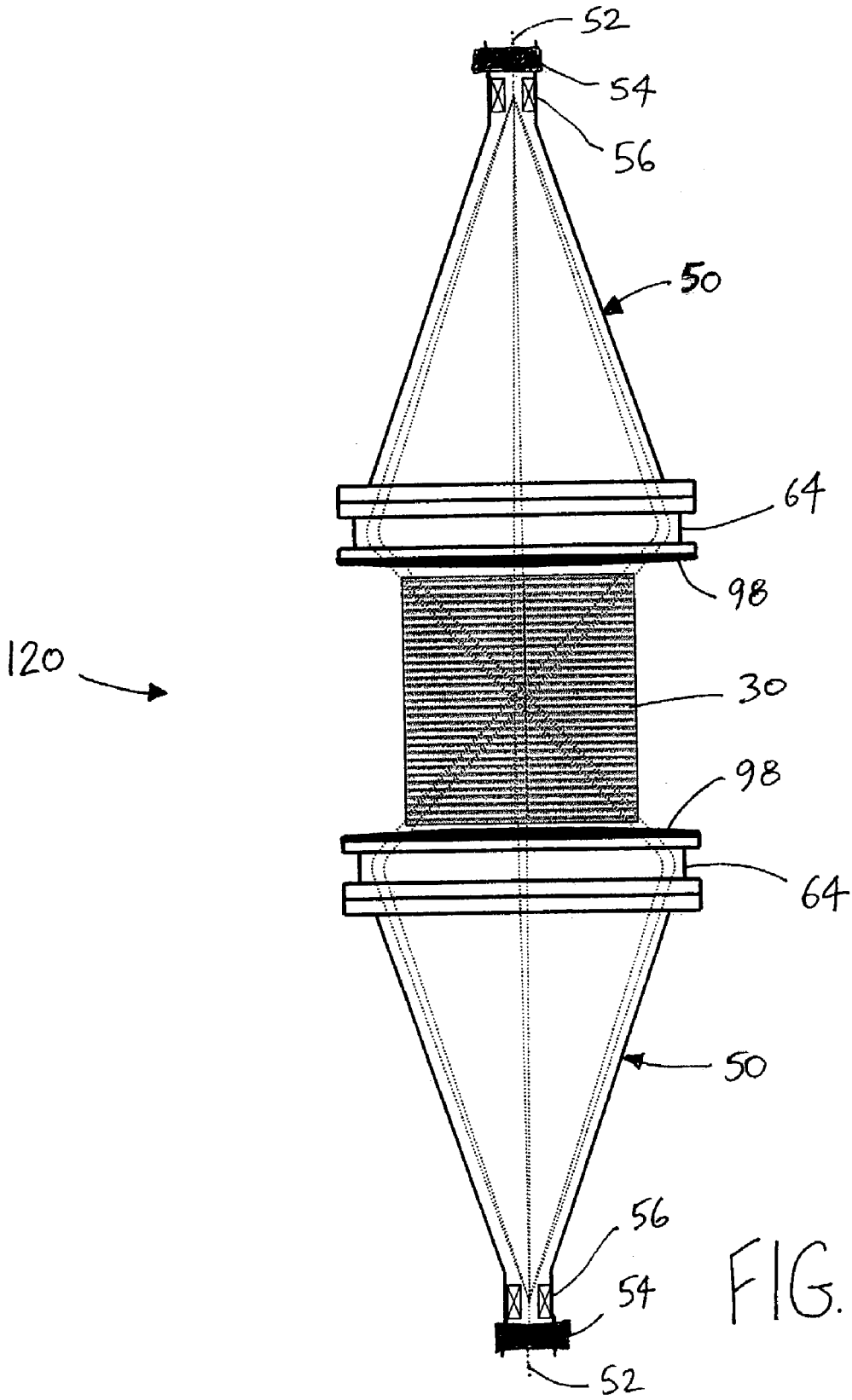
FIG. 9 is a diagram of an irradiation subsystem having two vertically arranged x-ray scan horns according to an embodiment of the present invention.

FIG. 9 is a diagram of irradiation subsystem 120 having two vertically arranged x-ray scan horns 50. The two vertical scan horn subsystems, in combination with the two horizontal scan horn subsystems shown in FIG. 8, complete the 360 degree radiation geometry. As is the case with the horizontal subsystems, the vertical subsystems will be offset so the exit radiation from one scan horn subsystem does not impinge upon the other.

Figure 10:
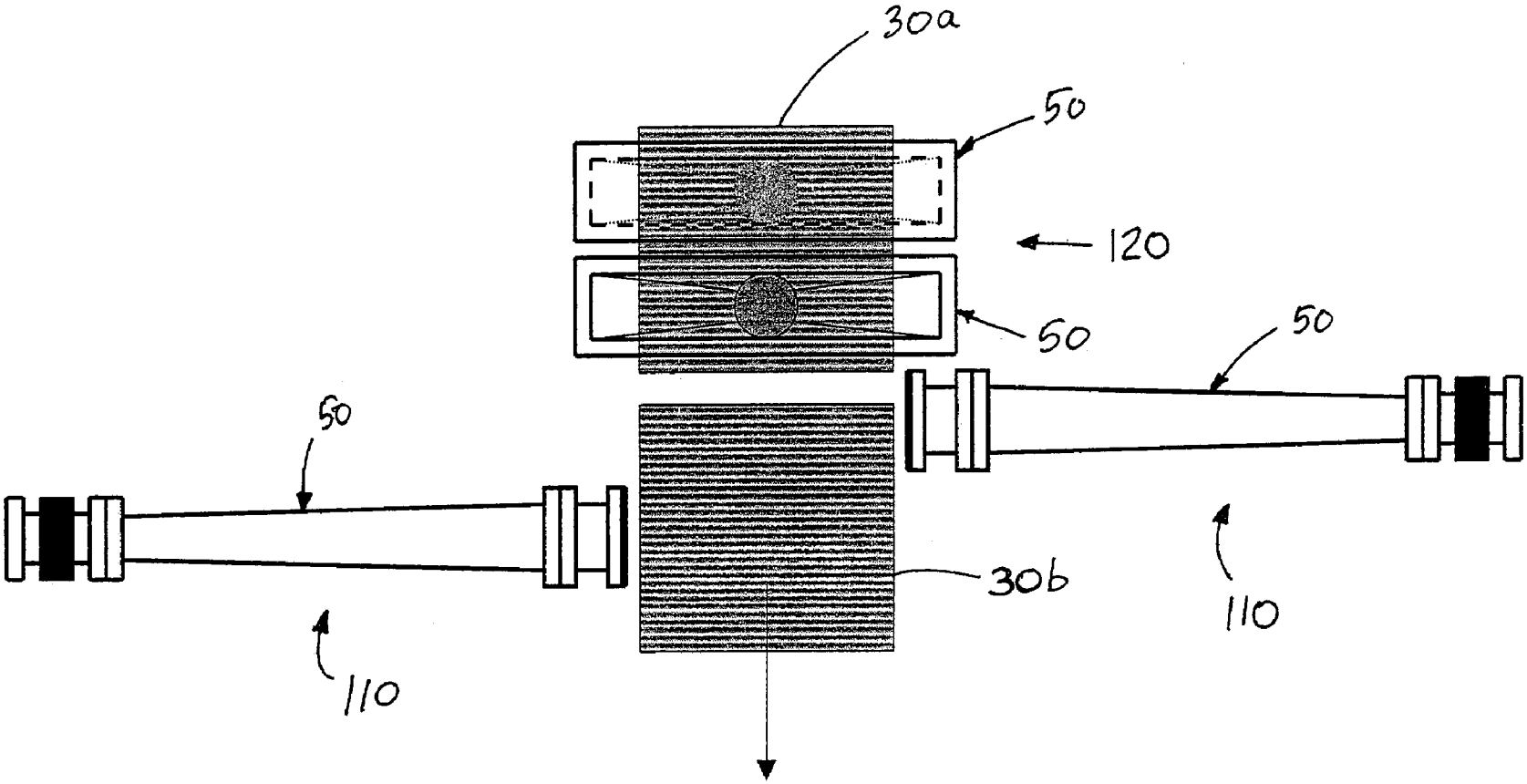
FIG. 10 is an overhead view of a pallet of material passing through a four scan horn irradiation system employing the subsystems shown in FIGS. 8 and 9.

FIG. 10 is an overhead view of a path for a pallet of material to pass through a four scan horn irradiation system employing subsystems 110 and 120 shown in FIGS. 8 and 9. When the pallet is in position 30*a*, it is treated by radiation directed through scan horns 50 of irradiation subsystem 120, and when the pallet is in position 30*b*, it is treated by radiation directed through scan horns 50 of irradiation subsystem 110. FIG. 10 shows the offsets of the facing scan horns 50. A set of four such scan horn subsystems together constitutes a complete radial x-ray system. Multiples of these sets of four scan horn subsystems may be associated together either for increased processing capacity or for redundancy that would allow continued processing even in the event of a failure of a single scan horn subsystem.

Figure 11:
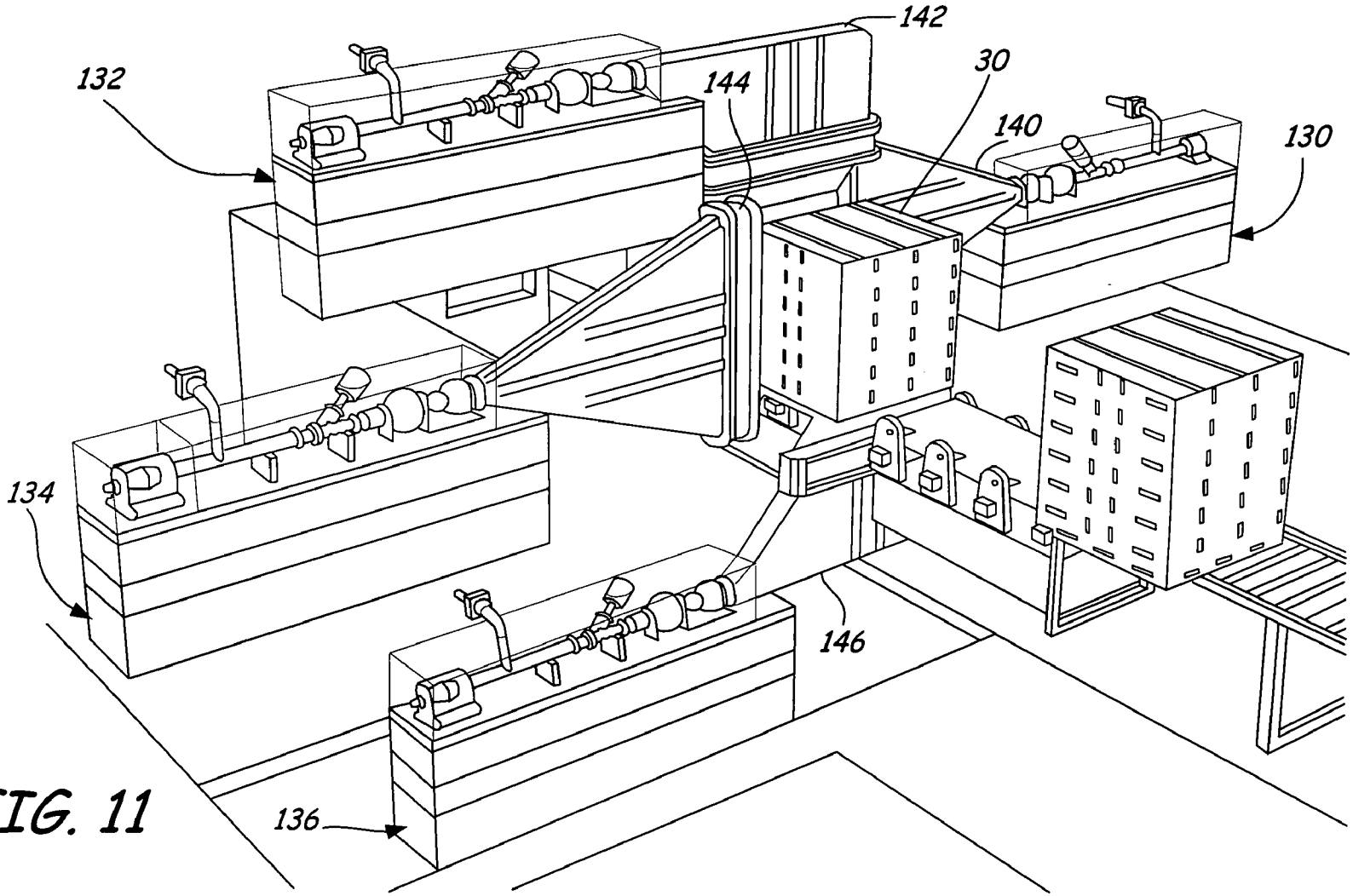
FIG. 11 is a diagram of an exemplary implementation of a four scan horn irradiation system according to an embodiment of the present invention.

FIG. 11 is a diagram of an exemplary implementation of a four scan horn irradiation system according to an embodiment of the present invention. The four scan horn irradiation system includes accelerators 130, 132, 134 and 136 for generating electron beams that are directed through scan horns 140, 142, 144 and 146, respectively, and are then converted to x-rays for irradiating pallet 30 of material. Each of scan horns 140, 142, 144 and 146 applies x-ray radiation to pallet 30 in a 90-degree quadrant of the full 360-degree radial exposure. Pallet 30 is conveyed horizontally through scan horns 140, 142, 144 and 146 at a controlled rate to ensure that a proper dose of radiation is received.

In a modified embodiment of the invention, pallet 30 of material may be conveyed through a scan horn assembly in a vertical direction rather than horizontally as is shown in FIG. 11. The vertical speed of pallet 30 is again precisely controlled to regulate the radiation dosage received. The vertical configuration of the system may employ four accelerators and scan horns, similar to the horizontal embodiment shown in FIG. 11, or may employ two or even one accelerator and scan horn with appropriate mechanical rotation to ensure that radiation is applied to pallet 30 radially from all sides.

Figure 12:
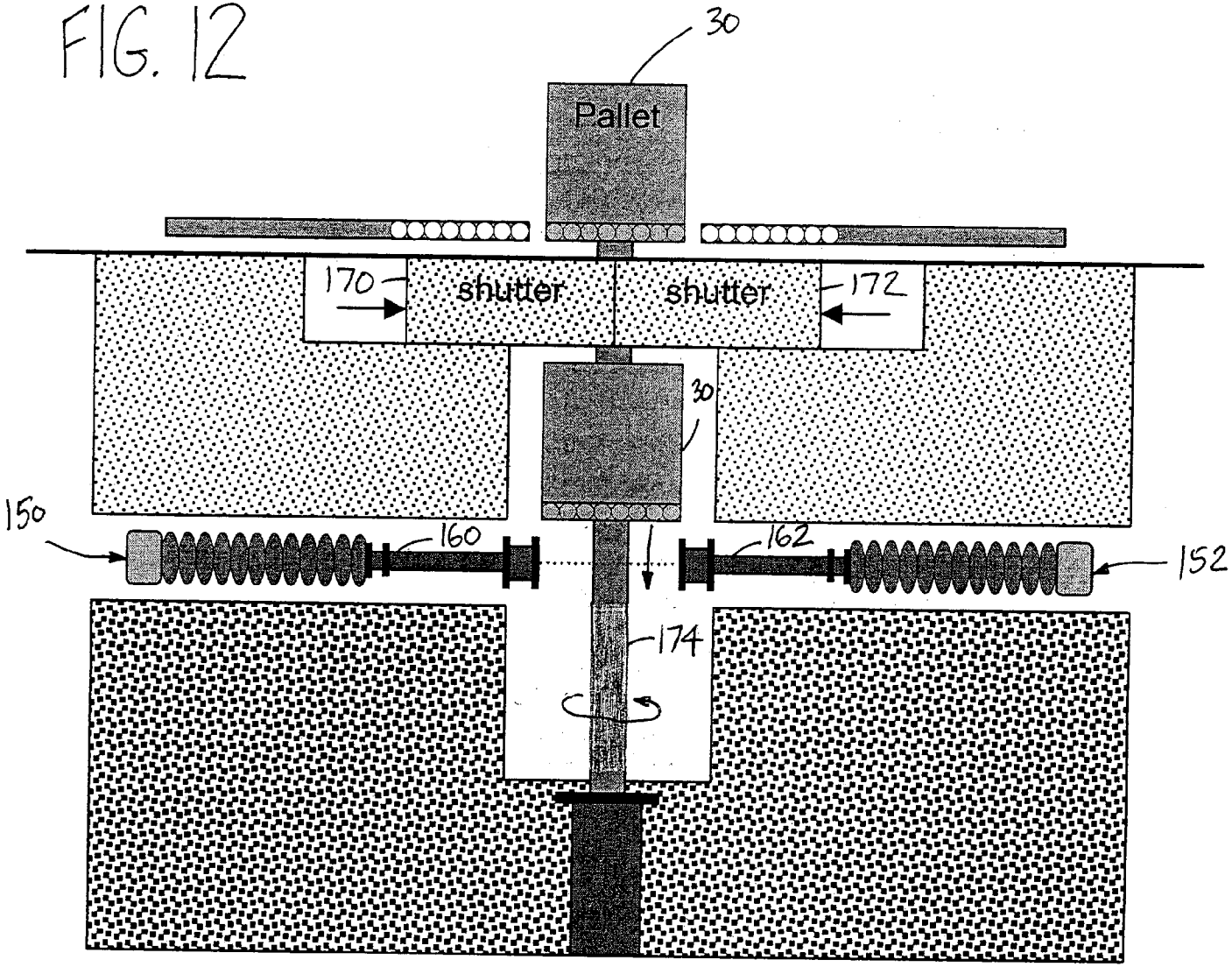
FIG. 12 is a diagram of an exemplary arrangement of a vertically configured irradiation system according to an embodiment of the present invention.

FIG. 12 is a diagram of an exemplary arrangement of a vertically configured irradiation system according to an embodiment of the present invention. The vertically configured irradiation system employs accelerators 150 and 152 for providing electron beams through scan horns 160 and 162, respectively. An x-ray conversion plate (not shown) is provided at the exit of each of scan horns 160 and 162 to convert the electron beam to x-rays. Although scan horns 160 and 162 are shown facing one another, in an exemplary embodiment they would be offset from one another so that radiation does not impinge upon the opposite scan horn. Shutter doors 170 and 172 are provided as part of the shielding structure of the system, and are operable to open to receive pallet 30 into irradiation chamber and close to completely shield the irradiation chamber.

In operation, shutter doors 170 and 172 are opened when pallet 30 is located directly above the irradiation chamber of the system. Pallet 30 is lowered through the aperture created by opening shutter doors 170 and 172, and shutter doors 170 and 172 are then closed to shield the irradiation chamber. Pallet 30 is lowered past scan horns 160 and 162 at a controlled rate in a first pass, with x-rays being provided to irradiate pallet 30 from two sides. Pallet 30 is then rotated 90 degrees by shaft 174 and lifted past scan horns 160 and 162 at a controlled rate in a second pass, with x-rays again being provided to irradiate pallet 30 from two sides. When both passes are complete, shutter doors 170 and 172 are opened, and pallet 30 is lifted all the way out of the irradiation chamber, having been irradiated from all four sides (with 90 degrees of exposure from each).

Figure 13:
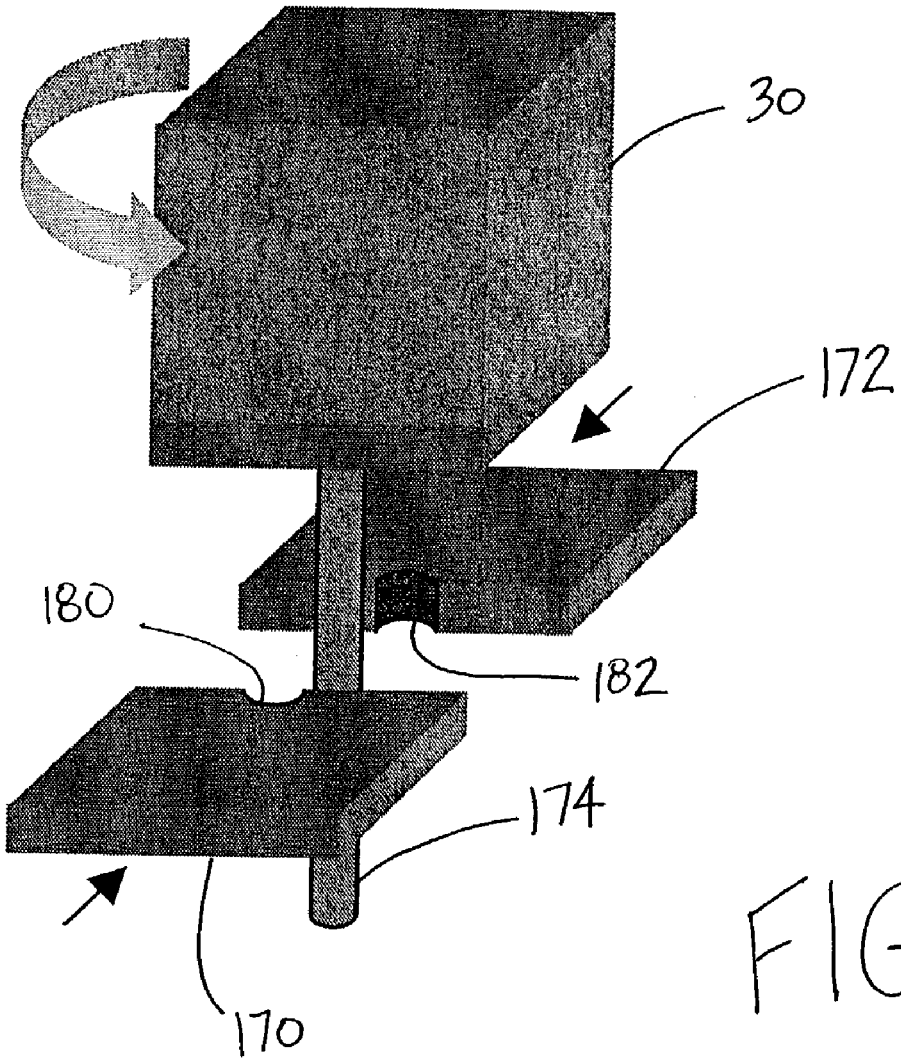
FIG. 13 is a diagram illustrating the relationship between shutter doors and a shaft in a raised irradiation chamber system according to an embodiment of the present invention.

The irradiation system shown in FIG. 12 can be modified so that pallet 30 is raised into an irradiation chamber rather than lowered. In such an embodiment, the shielding and shutter system is modified as well. FIG. 13 is a diagram illustrating the relationship between shutter doors 170 and 172 and shaft 174 in a raised irradiation chamber embodiment. Shaft 174 is operable to lift and lower pallet 30 between a conveying area and an irradiation area, and to lift or lower pallet 30 past scan horns at a controlled rate to control the radiation dose received by pallet 30. Shutter doors 170 and 172 are operable to open to allow pallet 30 to pass, and to close around shaft 174 to fully shield the irradiation area. In one embodiment, shutter doors 170 and 172 include cut-outs 180 and 182 to fit tightly around shaft 174 when shutter doors 170 and 172 are closed in the shielding position. In an exemplary embodiment, shaft is operable to lift or lower pallet 30 at a controlled speed while radiation is being applied (to control the radiation dosage received) and to lift or lower pallet 30 at a higher speed while radiation is not being applied (to transport pallet 30 at a maximum rate to improve the throughput of the system). Other modifications of the system's configuration will be apparent to those skilled in the art, within the scope of the teachings of the present invention.

The irradiation system shown in FIGS. 12 and 13 can also be modified to employ only one accelerator and scan horn. In this modified embodiment, four passes are required to irradiate pallet 30 from all four sides. Pallet 30 is lowered past the scan horn at a controlled rate, then is rotated and lifted so that the process can be repeated to expose pallet 30 from all four sides.

The present invention provides an x-ray irradiation system that is able to effectively irradiate large articles, such as cubical pallet of material having a thickness of up to about 48 inches. The ability to irradiate such a large volume of material results in an increase in the throughput of the system, and also is more convenient because of the system's capability to irradiate pallets that are already prepared for shipping. Radiation is applied to the material being irradiated from all sides, either by multiple x-ray providing sources each covering a portion of the total 360 degree exposure, or by one or more x-ray providing sources covering part of the desired 360 degrees of exposure in combination with a mechanical system that rotates the material being irradiated so that the x-ray providing source(s) cover the total 360 degrees of exposure in multiple passes. A novel scan horn and magnet configuration is provided which ensures that the large volume of material is irradiated with a precisely consistent radiation dose, achieving a low maximum/minimum dosage ratio.

Although the present invention has been described with reference to preferred embodiments, workers skilled in the art will recognize that changes may be made in form and detail without departing from the spirit and scope of the invention.

What is claimed is:

1. An assembly for irradiating an article having a center point, comprising:

an accelerator generating an electron beam;

a magnet assembly for shaping and deflecting the electron beam in a sweep path through a scan horn;

a compound bending magnet for directing the electron beam toward the center point of the article along the entire sweep path; and an x-ray conversion plate for converting the electron beam into an x-ray radiation beam.

2. The assembly of claim 1, wherein the magnet assembly comprises a quadrupole magnet.

3. The assembly of claim 1, wherein the magnet assembly comprises a deflection electromagnet operated by a control computer.

4. The assembly of claim 3, wherein the control computer is operable to adjust an intensity of the electron beam based on a position of the electron beam in the sweep path as deflected by the deflection electromagnet.

5. The assembly of claim 1, wherein the x-ray conversion plate has a variable thickness to equalize an intensity of x-rays exiting the conversion plate at different positions in the sweep path.

6. The assembly of claim 1, wherein the sweep path covers a 90 degree range of exposure.

7. An assembly for irradiating an article radially from all sides in a 360 degree exposure range, comprising:

a plurality of irradiating subsystems each providing x-ray radiation in a portion of the 360 degree exposure range, wherein each of the plurality of irradiating subsystems comprises:

an accelerator generating an electron beam;

a magnet assembly for shaping and deflecting the electron beam in a sweep path through a scan horn;

a compound bending magnet for directing the electron beam toward a center point of the article along the entire sweep path; and an x-ray conversion plate for converting the electron beam into an x-ray radiation beam; and a conveying system for carrying the article through the plurality of irradiating subsystems.

8. The assembly of claim 7, wherein each of the plurality of irradiating subsystems provides x-ray radiation in 90 degrees of the 360 degree exposure range.

9. The assembly of claim 7, wherein the magnet assembly comprises a quadrupole magnet.

10. The assembly of claim 7, wherein the magnet assembly comprises a deflection electromagnet operated by a control computer.

11. The assembly of claim 10, wherein the control computer is operable to adjust an intensity of the electron beam based on a position of the electron beam in the sweep path as deflected by the deflection electromagnet.

12. The assembly of claim 7, wherein the x-ray conversion plate has a variable thickness to equalize an intensity of x-rays exiting the conversion plate at different positions in the sweep path.

13. An assembly for irradiating an article radially from all sides in a 360 degree exposure range, comprising:

an irradiating subsystem providing x-ray radiation in a portion of the 360 degree exposure range;

a conveying system for repeatedly carrying the article through the irradiating subsystem and rotating the article in a plurality of passes to expose the article to radiation in the 360 degree exposure range, wherein the rotating occurs outside a path of the x-ray radiation.

14. The assembly of claim 13, wherein the irradiating subsystem comprises a single accelerator and scan horn covering a 90 degree exposure range, and wherein the conveying system carries and rotates the article through the irradiating subsystem in four passes.

15. The assembly of claim 14, wherein the irradiating subsystem comprises two accelerators and scan horns each covering a 90 degree exposure range, and wherein the conveying system carries and rotates the article through the irradiating subsystem in two passes.

16. The assembly of claim 13, wherein the conveying system comprises:

a rotatable elevator for carrying the article through the irradiating subsystem at a controlled rate and for rotating the article.

17. The assembly of claim 16, wherein the rotatable elevator is operable to carry the article through the irradiating subsystem in at least a first direction at the controlled rate when the irradiating subsystem is providing x-ray radiation, and is operable to carry the article through the irradiating subsystem in a second direction at a transport rate faster than the controlled rate when the irradiating subsystem is not providing x-ray radiation.

18. The assembly of claim 13, wherein the conveying system comprises a shutter assembly operable to open to receive the article into an irradiation area and to close to shield the irradiation area.

19. The assembly of claim 13, wherein the irradiating subsystem comprises at least one irradiating subassembly comprising:

an accelerator generating an electron beam;

a magnet assembly for shaping and deflecting the electron beam in a sweep path through a scan horn;

a compound bending magnet for directing the electron beam toward the center point of the article along the entire sweep path; and an x-ray conversion plate for converting the electron beam into an x-ray radiation beam.

20. The assembly of claim 19, wherein the magnet assembly comprises a quadrupole magnet.

21. The assembly of claim 19, wherein the magnet assembly comprises a deflection electromagnet operated by a control computer.

22. The assembly of claim 21, wherein the control computer is operable to adjust an intensity of the electron beam based on a position of the electron beam in the sweep path as deflected by the deflection electromagnet.

23. The assembly of claim 19, wherein the x-ray conversion plate has a variable thickness to equalize an intensity of x-rays exiting the conversion plate at different positions in the sweep path.

24. A method of irradiating an article having a center point, the method comprising:

(a) generating an electron beam;

(b) deflecting the electron beam at a controlled angle through a scan horn;

(c) directing the electron beam exiting the scan horn toward the center point of the article;

(d) iterating steps (b) and (c) through a sweep path; and (e) converting the directed electron beam exiting the scan horn into an x-ray radiation beam.

25. The method of claim 24, wherein the sweep path covers 90 degrees.

26. The method of claim 24, further comprising:

adjusting an intensity of the electron beam based on a position of the electron beam in the sweep path.

27. A method of irradiating an article radially from all sides in a 360 degree exposure range, the method comprising:

(a) providing x-ray radiation from a plurality of subsystems each covering a portion of the 360 degree exposure range so that a sum of exposure provided by the plurality of subsystems covers the entire 360 degree exposure range, each of the plurality of subsystems directing an x-ray radiation beam toward a center point of the article; and (b) carrying the article through the plurality of subsystems.

28. The method of claim 27, wherein the plurality of subsystems comprise four subsystems each covering 90 degrees of the 360 degree exposure range.

29. A method of irradiating an article radially from all sides in a 360 degree exposure range, the method comprising:

(a) providing x-ray radiation from at least one subsystem in a portion of the 360 degree exposure range; and (b) carrying the article through the at least one subsystem;

(c) rotating the article; and (d) repeating steps (b) and (c) in a plurality of passes to expose the article to x-ray radiation in the 360 degree exposure range, wherein steps (a) and (c) are performed at different times.

30. The method of claim 29, wherein x-ray radiation is provided by a single subsystem in a 90 degree exposure range and full 360 degree exposure is achieved in four passes.

31. The method of claim 29, wherein x-ray radiation is provided by two subsystems each having a 90 degree exposure range and full 360 degree exposure is achieved in two passes.

* * * * *